US012656035B2

(12) United States Patent
Joy et al.

(10) Patent No.: US 12,656,035 B2
(45) Date of Patent: Jun. 16, 2026

(54) OBSTRUCTION DETECTION FOR A HEAT PUMP WATER HEATER SYSTEM

(71) Applicant: Bradford White Corporation, Ambler, PA (US)

(72) Inventors: Stephen Kimball Joy, Union, NH (US); Richard O. Oliveira, New Durham, NH (US); Joseph Albert Stocker, Dover, NH (US)

(73) Assignee: Bradford White Corporation, Ambler, PA (US)

( * ) Notice: Subject to any disclaimer, the term of this patent is extended or adjusted under 35 U.S.C. 154(b) by 93 days.

(21) Appl. No.: 18/669,870

(22) Filed: May 21, 2024

(65) Prior Publication Data

US 2025/0362067 A1 Nov. 27, 2025

(51) Int. Cl.
*F25B 47/02* (2006.01)
*F24H 4/02* (2022.01)

(52) U.S. Cl.
CPC ..... *F25B 47/022* (2013.01); *F24H 4/02* (2013.01); *F25B 2700/11* (2013.01); *F25B 2700/19* (2013.01); *F25B 2700/2103* (2013.01)

(58) Field of Classification Search
CPC ..... F25B 47/022; F25B 2700/11; F25B 2700/197; F24H 4/02
USPC ..... 62/81
See application file for complete search history.

(56) References Cited

U.S. PATENT DOCUMENTS

| | | | |
|---|---|---|---|
| 9,692,347 B2 | 6/2017 | Hung et al. | |
| 2017/0082308 A1 * | 3/2017 | Gokhale | F25D 21/02 |
| 2020/0191458 A1 | 6/2020 | Read et al. | |

FOREIGN PATENT DOCUMENTS

EP 0278701 B1 4/1994

* cited by examiner

*Primary Examiner* — Steve S Tanenbaum
(74) *Attorney, Agent, or Firm* — Willard Quinn PLLC

(57) ABSTRACT

A heat pump water heater system includes a compressor configured to compress a coolant and an evaporator including an evaporator fan that is configured to cause air to flow through the evaporator when the evaporator fan is actuated. A first heat exchanger fluidly interposes the compressor and the evaporator and is configured to transfer heat between the coolant and water flowing through the first heat exchanger. A temperature sensor is configured to detect a temperature of ambient air. A pressure sensor is configured to detect an air pressure at the evaporator. Control circuitry is in communication with the temperature sensor and the pressure sensor. The control circuitry is configured to determine presence of an obstruction on the evaporator and classify the obstruction based on the temperature of the ambient air.

24 Claims, 3 Drawing Sheets

OBSTRUCTION DETECTION FOR A HEAT PUMP WATER HEATER SYSTEM

BACKGROUND OF THE DISCLOSURE

The present disclosure generally relates to obstruction detection for a heat pump water heater system, and more specifically, to a system and method for utilizing temperature and pressure to determine and classify air obstructions of a heat pump water heater.

SUMMARY OF THE DISCLOSURE

According to one aspect of the present disclosure, a heat pump water heater system includes a compressor configured to compress a coolant and an evaporator including an evaporator fan that is configured to cause air to flow through the evaporator when the evaporator fan is actuated. A first heat exchanger fluidly interposes the compressor and the evaporator and is configured to transfer heat between the coolant and water flowing through the first heat exchanger. A temperature sensor is configured to detect a temperature of ambient air. A pressure sensor is configured to detect an air pressure at the evaporator. Control circuitry is in communication with the temperature sensor and the pressure sensor. The control circuitry is configured to determine presence of an obstruction on the evaporator and classify the obstruction based on the temperature of the ambient air.

According to another aspect of the present disclosure, a heat pump water heater system includes a compressor configured to compress a coolant. An evaporator includes an evaporator fan that is configured to cause air to flow through the evaporator when the evaporator fan is actuated. The system includes a first heat exchanger fluidly interposing the compressor and the evaporator and configured to transfer heat between the coolant and water flowing through the first heat exchanger. The system includes a temperature sensor configured to detect a temperature of ambient air, a pressure sensor configured to detect an air pressure at the evaporator, and control circuitry in communication with the temperature sensor and the pressure sensor. The control circuitry is configured to determine presence of an obstruction on the evaporator and determine a frost condition or a non-frost condition of the evaporator in response to the temperature of the ambient air.

According to yet another aspect of the present disclosure, a heat pump water heater system includes a compressor configured to compress a coolant. The system includes an evaporator including an evaporator fan that is configured to cause air to flow through the evaporator when the evaporator fan is actuated. The system includes a heat exchanger fluidly interposing the compressor and the evaporator and configured to transfer heat between the coolant and water flowing through the heat exchanger. The system includes at least one valve fluidly interposing the compressor and the evaporator and moveable between an operating position and a defrost position. The system includes a temperature sensor configured to detect a temperature of ambient air. The system includes a pressure sensor configured to detect an air pressure at the evaporator. The system includes control circuitry in communication with the temperature sensor and the pressure sensor. The control circuitry is configured to determine presence of an obstruction on the evaporator, determine a frost condition or a non-frost condition of the evaporator in response to the temperature of the ambient air, and control the at least one valve to position the at least one valve to the defrost position in response to determining the frost condition.

According to yet another aspect of the present disclosure, a method of operating a heat pump water heater system includes compressing a coolant via a compressor, drawing air over an evaporator via actuation of an evaporator fan, transferring heat between the coolant and water flowing through a first heat exchanger fluidly interposing the compressor and the evaporator, detecting a temperature of ambient air via a temperature sensor, detecting an air pressure at the evaporator via an pressure sensor, determining presence of an obstruction on the evaporator via control circuitry in communication with the temperature sensor and the pressure sensor, and classifying the obstruction based on the temperature of the ambient air.

These and other features, advantages, and objects of the present disclosure will be further understood and appreciated by those skilled in the art by reference to the following specification, claims, and appended drawings.

Figure 1:
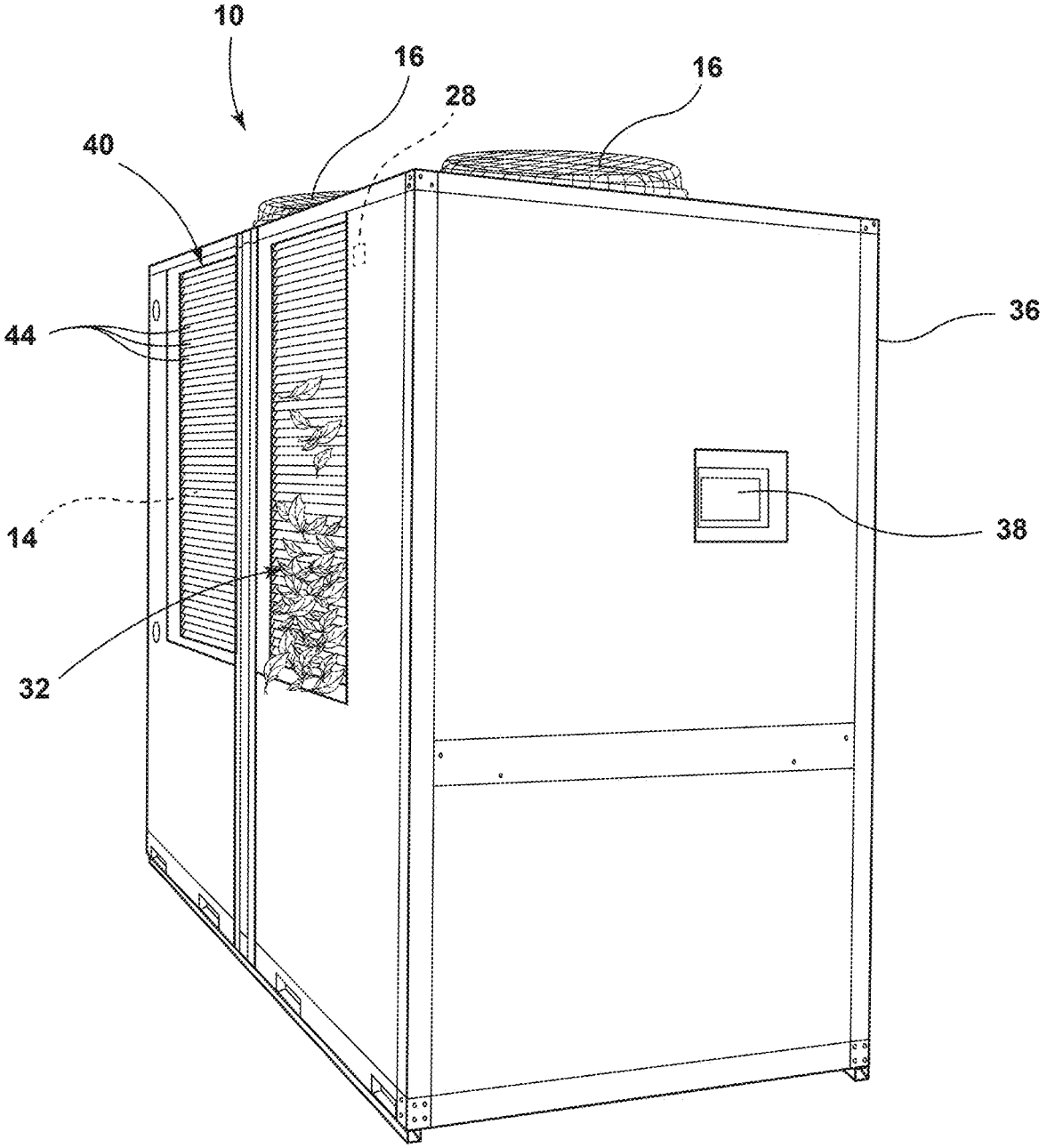
FIG. 1 is a perspective elevational view of a heat pump water heater system.

The components in the figures are not necessarily to scale, emphasis instead being placed upon illustrating the principles described herein.

DETAILED DESCRIPTION

The present illustrated embodiments reside primarily in combinations of method steps and apparatus components related to obstruction detection for a heat pump water heater. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Figure 2:
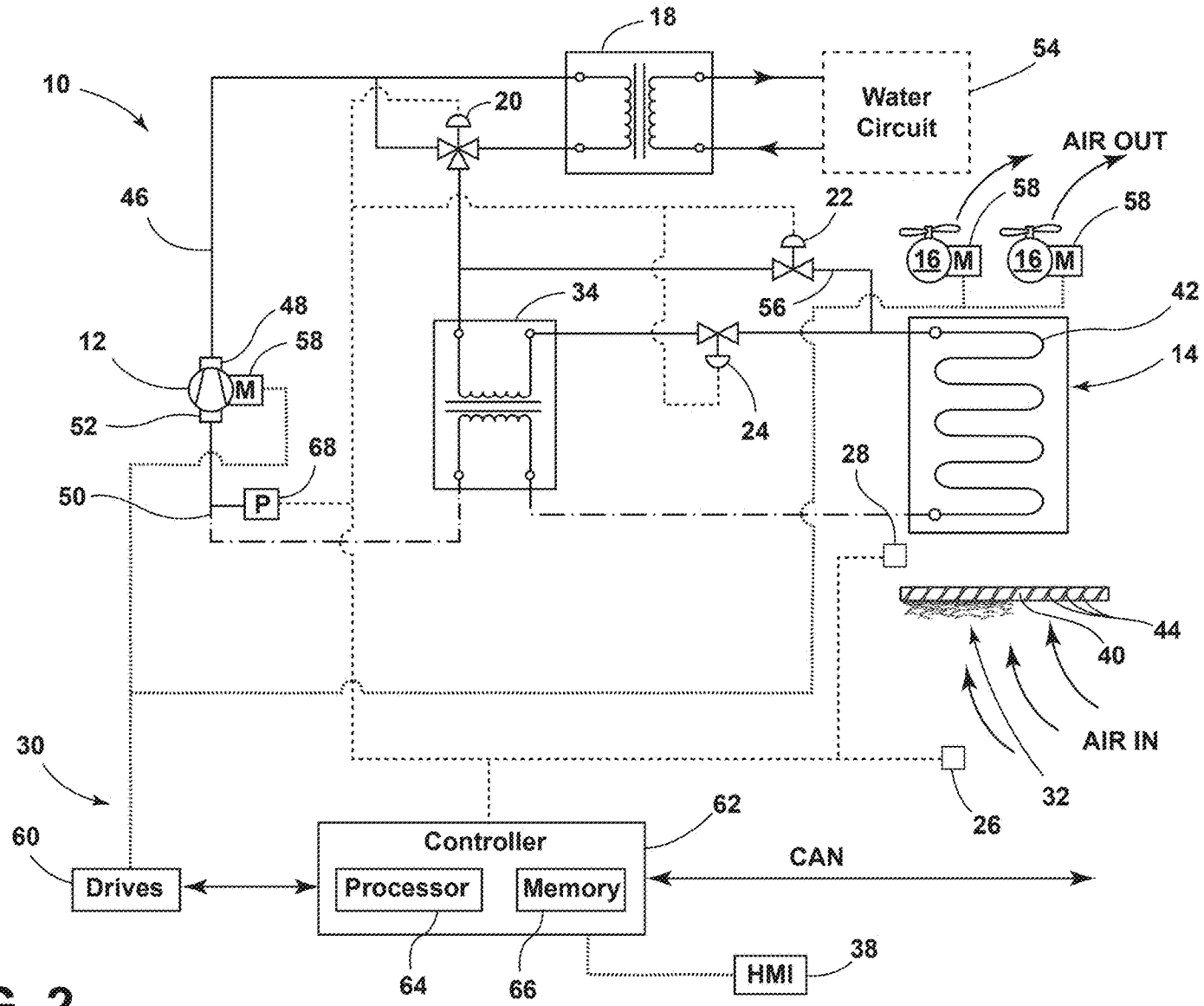
FIG. 2 is a schematic view of a heat pump water heater system according to an aspect of the present disclosure.
Figure 3:
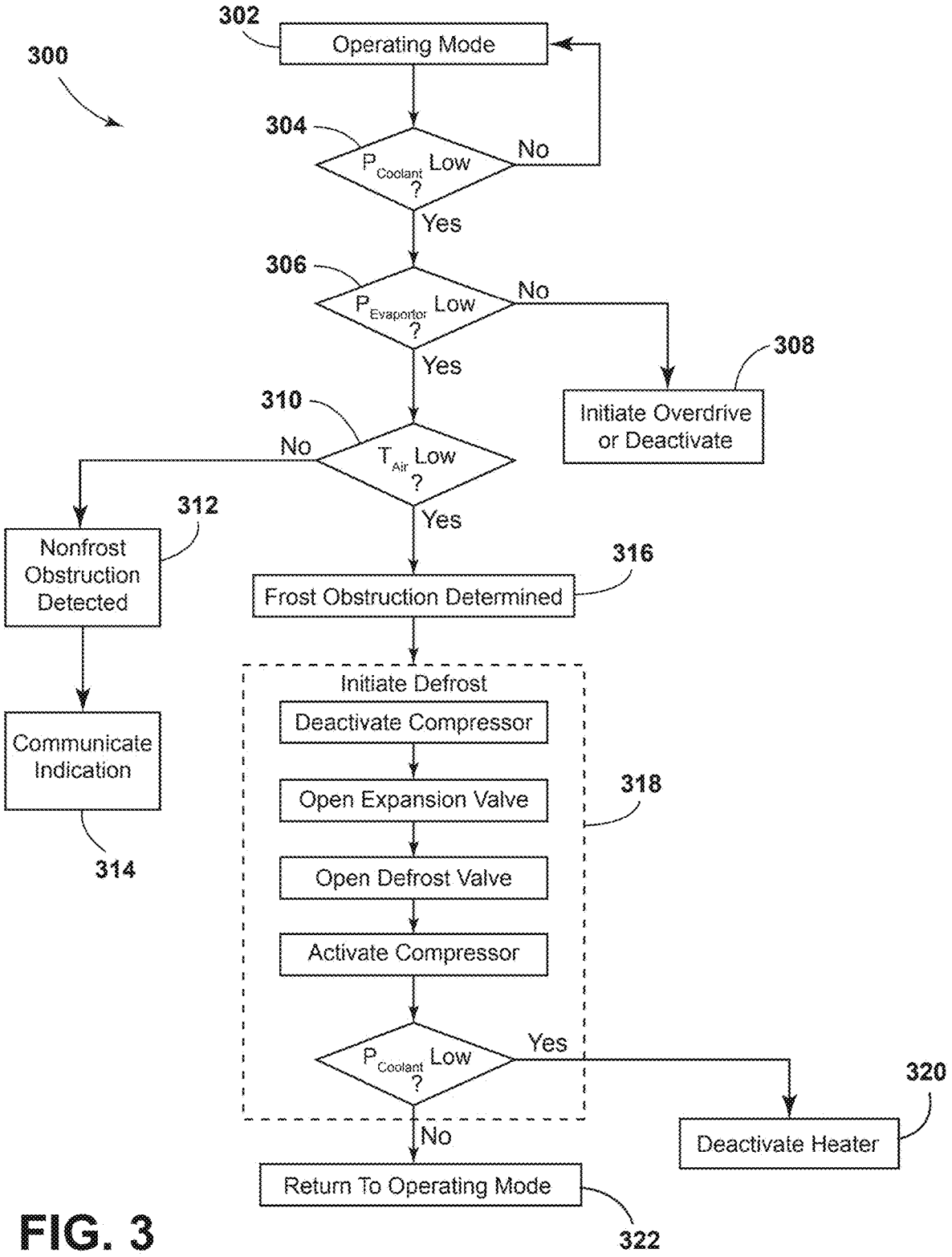
FIG. 3 is a flow diagram demonstrating a method of operating a heat pump water heater system by utilizing obstruction detection and classification.

Referring to FIGS. 1-3, reference numeral 10 generally designates a heat pump water heater system. The system 10 generally provides for enhanced efficiency by limiting defrost cycles. The system 10 further provides for enhanced diagnostics for fault conditions by detecting and classifying air blockages.

With continued reference to FIGS. 1-3, the system 10 includes a compressor 12 configured to compress a coolant and an evaporator 14 including an evaporator fan 16 that is configured to cause air to flow through the evaporator 14 when the evaporator fan 16 is actuated. A first heat exchanger 18 fluidly interposes the compressor 12 and the evaporator 14 and is configured to transfer heat between the coolant and water flowing through the first heat exchanger 18. At least one valve 20, 22, 24 fluidly interposes the compressor 12 and the evaporator 14 and is moveable between an operating position and a defrost position. The system 10 includes a temperature sensor 26 configured to detect a temperature of ambient air and a pressure sensor 28 configured to detect an air pressure at the evaporator 14. Control circuitry is in communication with the temperature sensor 26 and the pressure sensor 28. The control circuitry is configured to determine presence of an obstruction 32 on the evaporator 14, determine a frost condition or a non-frost condition of the evaporator 14 in response to the temperature of the ambient air, and control the at least one valve 20, 22, 24 to position the at least one valve 20, 22, 24 to the defrost position in response to determining the frost condition. In some examples, the system 10 also includes a second heat exchanger 34 (e.g., a recuperator 34) downstream of the first heat exchanger 18 for exchanging heat from the coolant in one location of the system 10 to the coolant in another location of the system 10.

Referring now to FIG. 1, the system 10 can embody an outdoor commercial heat pump configured to draw heat from outside air to heat water. The system 10 include a housing 36 in which heat exchange between the coolant and the water occurs. While not illustrated in detail, ports may be provided in the housing 36 for receiving water inlet and water outlet piping. The system 10 can include a user interface 38, such as a human-machine interface (HMI) having a display for displaying information related to the system 10. For example, the user interface 38 may be operable as an indicator for indicating operation states, faults, statuses, etc. of the system 10. Other indicators and/or user inputs may be provided on the housing 36 for controlling and/or monitoring the system 10 such as indicator lights, horns, buzzers, or the like. It is contemplated that the system 10 may be controlled via other user interfaces remotely from the housing 36 (e.g., mobile devices, remote HMIs).

The system 10 can be positioned exterior to a facility or within the facility. In an outdoor environment, the system 10 may be exposed to high and/or low ambient temperatures. Further, the system 10 can be subject to blockage via debris or other obstructions 32 due to environmental factors (e.g., weather, surroundings). An air intake assembly 40 is positioned on the housing 36. The air intake assembly 40 can include vents that allow air to be drawn into the housing 36. The evaporator fans 16 are configured to draw air through the air intake assembly 40 and across an evaporator coil 42 (FIG. 2) of the evaporator 14. In the present example, the evaporator fans 16 are positioned atop the housing 36, though the evaporator fans 16 can be positioned anywhere on the housing 36 for drawing air through the air intake assembly 40. In the example shown, leaves block the evaporator 14. The evaporator coil 42 can be positioned behind the air intake assembly 40. When the evaporator fans 16 are activated, air is drawn through the air intake assembly 40 and over the evaporator coil 42 to transfer heat to the system 10 from the air. The amount and/or rate of airflow over the evaporator coil 42 can affect the rate of heat transfer, and therefore the efficiency, of the evaporator 14. Accordingly, a level of blockage of the air intake can be proportional or otherwise correspond to an efficiency of the evaporator 14. The system 10 can provide an enhanced method of detection and classification of these obstructions 32 and control the system 10 based on the classification.

Referring to FIGS. 1 and 2, the pressure sensor 28 can be positioned adjacent to the air intake assembly 40 for measuring pressure differential across the evaporator coil 42. For example, the pressure sensor 28 can be positioned between fins 44 of the air intake assembly 40 and the evaporator coil 42 and measure a suction pressure of the air intake assembly 40. The pressure sensor 28 can generally detect a pressure of the air flowing across the evaporator coil 42 due to operation of the evaporator fans 16. The pressure sensor 28 can include a pressure switch, a pressure gauge, a piezoelectric pressure sensor, a resistive pressure sensor, or any other pressure sensing device. While one pressure sensor 28 is illustrated in FIGS. 1 and 2, it is contemplated that a plurality of pressure sensors 28 can be provided adjacent to the evaporator coil 42 to measure a plurality of air pressures. For example, the control circuitry 30 (FIG. 2) can average or otherwise amalgamate pressure data to determine an overall pressure level of air at the evaporator 14.

Referring now to FIG. 2, components located in the housing 36 of FIG. 1 are schematically illustrated. The system 10 includes a supply line 46 fluidly coupled to an outlet 48 of the compressor 12 and a return line 50 fluidly coupled to an inlet 52 of the compressor 12. During operation, the compressor 12 causes compressed coolant to flow through the supply line 46 to a gas cooler heat exchanger (e.g., the first heat exchanger 18) to heat water flowing through a water circuit 54 to provide hot water to a hot water tank system. The system 10 includes a recuperator 34 (the second heat exchanger 34) whereby, when the system 10 is in an operating mode, coolant flows through the recuperator 34 to transfer heat to coolant flowing through the return line 50 before the coolant in the return line 50 returns to the compressor inlet 52. Coolant exiting the recuperator 34 flows through an expansion valve 24 whereby a temperature of the coolant is reduced before the coolant flows through the evaporator 14 in the operating mode. Coolant that has been pressurized by the compressor 12 flows to the evaporator 14 (e.g., from the recuperator 34). Coolant exiting the evaporator 14 is returned to the inlet 52 of the compressor 12 by the return line 50.

The at least one valve 20, 22, 24 can include the expansion valve 24 and one or more defrost valves 20, 22 that are configured to move or adjust between the operating position and the defrost positions. The valves 20, 22, 24 can fluidly interpose the compressor 12 and the evaporator 14. For example, a first valve 20 may control fluid communication between the compressor 12 and the first heat exchanger 18. A second valve 22 may fluidly interpose the first valve 20 and the evaporator 14 along a defrost bypass line 56. The first valve 20 can be a three-way valve for adjusting where coolant in the supply line 46 is diverted. The second valve 22 can be a two-way valve for allowing or restricting coolant flow through the defrost bypass line 56. Additional valves may be provided for selectively limiting/allowing fluid paths between the compressor 12 and the evaporator 14 by opening/closing adjustments.

Still referring to FIG. 2, motors 58 may be provided for activating the evaporator fans 16 and the compressor 12. The motors 58 may be controlled by the control circuitry 30 via one or more drives 60, such as variable-frequency drives (VFDs) that can adjust a speed, or RPM, of the motors 58. Via the drives 60, the control circuitry 30 can thus control a speed of operation of compressor 12, whereby a mass flow rate of compressor 12 can be adjusted. The airflow rate across the evaporator coil 42 can also be controlled by adjusting the speed of the evaporator fans 16 using variable speed control. Byway of example, if the ambient temperature is warmer, which can correspond to higher operating pressures, the compressor 12 and/or evaporator fans 16 can be operated at lower speeds (frequencies). If the ambient temperature is cooler, the compressor 12 and/or evaporator fans 16 can be controlled to operate at higher speeds (frequencies). For example, a second VFD may be configured to control a frequency of a motor 58 driving each or both of the evaporator fans 16, and the controller 62 may communicate instructions or signals to the second VFD to speed up or slow down this/these motors 58. Thus, the controller 62 of the heat pump water heater system 10 can be configured to provide an active and continuous control over the components of the heat pump water heater system 10 to optimize coefficient of performance (COP).

With continued reference to FIG. 2, the control circuitry 30 can include at least one controller 62 that includes a processor 64 and a memory 66 storing instruction that, when executed by the processor 64, causes the controller 62 to operate the system 10. The control circuitry 30 can include a programmable logic device (PLD), such as a programmable logic controller (PLC), and one or more input/output modules configured to communicate with the compressor 12, the evaporator 14, and the sensing devices of the system 10. The control circuitry 30 can also be in communication with other controllers on a controller-area-network (CAN) bus or other wireless or wired connection that provides digital communication between systems. The sensing devices can include various sensing devices for detecting temperature, pressure, flow-rate, or any other parameter of the system 10 measurable by sensing devices (e.g., the temperature sensor 26, the pressure sensor 28, a coolant pressure switch 68, coolant temperature switches, mass-flow rate sensors). The coolant pressure switch 68 can be fluidly coupled to the return line 50 and be configured to detect a pressure of the coolant. In some examples, another pressure detection device is provided at the supply line 46, and the control circuitry 30 can determine a pressure differential across the compressor 12.

The control circuitry 30 can monitor the pressure of the coolant and calculate, or determine, a corresponding pressure of the coolant because the temperature of the coolant is proportional to the pressure of the coolant. Based on the temperature/pressure of the coolant, the control circuitry 30 can determine an efficiency of operation of the system 10. For example, significantly low temperatures of the refrigerant can correspond to low heat exchange levels occurring at the evaporator 14. Accordingly, in addition to utilizing the ambient temperature and the intake pressure, the control circuitry 30 can monitor the coolant pressure to determine low-efficiency operation.

With continued reference to FIG. 2, in the operating mode, the first valve 20 limits coolant from directly flowing from the compressor 12 to the second heat exchanger 34. The coolant is therefore compressed by the compressor 12 and flows through the first heat exchanger 18 to allow the water to be heated. Coolant exiting the first heat exchanger 18 then flows through the first valve 20 to the recuperator 34. The second valve 22 is closed to close off the defrost bypass line 56. Accordingly, the coolant flows through the second heat exchanger 34 to provide heat to coolant in the return line 50. After exiting the second heat exchanger 34, the coolant expands at the expansion valve 24 as previously described. As the coolant flows through the evaporator coil 42, heat from the ambient air is absorbed and transferred to the system 10. The coolant then returns to the compressor 12 via the return line 50 to be compressed.

In the defrost mode, the defrost valves 20, 22 are controlled to bypass the first heat exchanger 18 and the second heat exchanger 34 (via the defrost bypass line 56). For example, the first valve can be controlled to bypass the first heat exchanger 18, and the second valve 22 can be controlled to open the defrost bypass line 56. Thus, rather than primarily exchanging heat to the water or passing through the recuperator 34, the warm coolant is directly fed to the evaporator 14 to warm the evaporator coil 42. Thus, when a frost condition is present, the defrost mode can be initiated to melt the frost. By removing the frost, the air intake assembly 40 can be cleared to draw more air over the evaporator coil 42 and enhance efficiency.

Because operation in the defrost mode results in more heat being transferred to the evaporator 14 than during the operating mode, the system 10 is configured to limit transition to the defrost mode to when frost conditions are likely present. The system 10 utilizes the pressure detected by the pressure sensor 28 and air temperature detected by the ambient temperature sensor 26 to determine presence of the obstruction 32 and classify it as a frost obstruction or a non-frost obstruction. It is contemplated that the obstruction 32 on the evaporator 14 can refer to any blockage at an outside or inside of the intake assembly 40, a space between the intake assembly 40 and the evaporator coil 42, or any space through which the evaporator fan 16 is configured to draw air (e.g., on evaporator coil 42). By utilizing the temperature and pressure of the air, the control circuitry 30 can increase runtime in the operating mode by providing enhanced diagnostics and messaging to service technicians and limiting unneeded defrost cycles. This detection can, in turn, further provide for enhanced energy management.

The control circuitry 30 can also extend low-ambient operation or provide efficient high-ambient operation by utilizing dynamic control of the motors 58 and valves 20-24. For example, the ambient temperature in the ambient space drops, the evaporator 14 may be required to operate at lower temperatures in order to keep balance between the energy being released from the air and the energy absorbed into the refrigerant. For pure fluids such as $CO_2$ (which may be the coolant), pressure and temperature are dependent as the fluid changes phase from liquid to gas, such that the operating pressure also drops. For a given speed (e.g., rpm) of the compressor 12, the mass flow rate the compressor 12 can provide also drops with temperature and pressure, decreasing the overall capacity of the system 10 to transfer heat and heat the water supplied to the hot water tank system. The speed (mass flow rate) of the compressor 12 may be increased at lower ambient temperatures to compensate for reduced mass flow rates that would occur at a constant compressor speed to thereby permit heat pump water heater system to operate at lower ambient temperatures or to permit the system 10 to utilize a smaller compressor (e.g., a less powerful motor).

Referring now to FIG. 3, a method 300 of operating the system 10 is demonstrated. At step 302 of the method 300, the system 10 is operating in the operating mode. For example, in the operating mode, the control circuitry 30 controls the valves 20-24, compressor 12, and other components of the heat pump to gather heat from the ambient air via the evaporator 14 and transfer heat to the water circuit 54. The heat pump can generally operate in the operating mode when there are no faults present. At step 304, the method 300 checks for whether a pressure of the coolant (e.g., as detected by one or more pressure switches of the system 10) is below a programmed coolant pressure threshold. If not, the operating mode is maintained (step 302). If the coolant pressure is low, the method 300 can compare a pressure drop across the evaporator 14 (e.g., as detected by the pressure sensor 28) to a programmed air pressure threshold at step 306. If the air pressure at the evaporator 14 is not below the air pressure threshold, the method 300 continues to step 308 where the control circuitry 30 can overdrive the system 10 or deactivate the system 10 according to programmed instructions. In general, the control circuitry 30 can adjust at least one operation of the operating mode in response to determining the non-frost condition and may further, or alternatively, control the indicator (e.g., the user interface 38) to indicate the adjustment of the operation(s). For example, when the pressure of the coolant is low, but the pressure across the evaporator 14 is not, the control circuitry 30 can determine that a blockage is likely not causing the low coolant conditions, and the control circuitry 30 can overdrive the compressor 12 to extend low ambient operations. In other examples, the control circuitry 30 can determine a fault of the pressure sensor 28. As illustrated, in some examples, the system 10 can be deactivated or shut down in response to the low coolant pressure and standard pressure range at the evaporator 14 due to this condition being related to other causes or unclassified causes.

If the air pressure at the evaporator 14 is below the programmed air pressure threshold, the method 300 proceeds to step 310 in which the control circuitry 30 compares the ambient air temperature to a temperature threshold (e.g., at, near, below, or near freezing). Other temperature thresholds may be used, such as temperatures above freezing. If the air temperature is above the temperature threshold, the control circuitry 30 can determine a non-frost obstruction condition of the evaporator 14 at step 312. For example, because the temperature is not below the temperature threshold at step 312 but there is low air pressure at the evaporator 14, the control circuitry 30 can communicate an indication that the evaporator 14 is likely blocked. For example, the air intake may be blocked by debris from an outdoor or indoor environment, and such debris is unlikely to be ice or frost accumulation. It is contemplated that the control circuit can concurrently or sequentially gather the air pressure information when the evaporator fans 16 are activated. For example, the pressure across the evaporator 14 can be monitored/tracked when air is being drawn into the housing 36 or across the evaporator coil 42. Accordingly, in some examples, the control circuitry 30 can monitor a status of the evaporator fans 16, or blowers, and only utilize the air pressure comparison when the blowers are running in some examples.

At step 314, an indication of the obstruction can be communicated to, for example, the user interface 38. In some examples, the indication is communicated to other systems in communication with the system 10 (e.g., facility maintenance systems, remote service systems). The indication can include lights, sounds, textual messages, images, or the like. In one example, the HMI is configured to present a text indicating a non-frost obstruction is detected. Following step 314, the method may further deactivate the system 10 or initiate a shut-off timer after the non-frost obstruction condition is determined. Additional steps for changing operation of the system 10 may be initiated following detection of the obstruction.

With continued reference to FIG. 3, if the ambient air temperature is below the temperature threshold at step 310, the control circuitry 30 can determine a frost obstruction at step 316 and initiate a defrost cycle at step 318. In the defrost mode, the control circuitry 30 deactivates the compressor 12, opens the expansion valve 24, then opens the defrost valves 20, 22 to bypass the first heat exchanger 18 and the second heat exchanger 34, then activates the compressor 12. Because heat carried by the coolant is not released to the water circuit 54, the heat is primarily transferred to the evaporator coil 42. The warmed evaporator coil 42 can melt the frost/ice accumulated on and/or around the evaporator 14. The defrost mode may be on a timer, such that, following a set time (e.g., five minutes) the control circuitry 30 again checks the pressure of the coolant. If the pressure of the coolant is still below the coolant pressure threshold, the control circuitry 30 can deactivate the system 10 at step 320. In some examples, an indication of unsuccessful defrost can be communicated and/or reported at the user interface 38 or in any way previously described. If the pressure of the coolant is not below the coolant pressure threshold, the control circuitry 30 can return the system 10 to the operating mode at step 322 having likely defrosted the evaporator 14.

It is contemplated that the method 300 described above is exemplary and non-limiting. For example, the order of checking temperatures and pressures may differ, and the resulting actions performed by the control circuitry 30 (e.g., indicating communications, deactivating the system 10, adjusting between operating mode and defrost mode) can differ. Further, additional operations related to control of the valves, the compressor 12, the evaporator 14, and other components of the system 10 can be performed concurrently or sequentially by the control circuitry 30, as previously described. For example, the control circuitry 30 can change speeds of the motors 58 depending on the temperatures and/or pressures of the system 10 or the surroundings.

According to another aspect of the present disclosure, a heat pump water heater system includes a compressor configured to compress a coolant and an evaporator including an evaporator fan that is configured to cause air to flow through the evaporator when the evaporator fan is actuated. A first heat exchanger fluidly interposes the compressor and the evaporator and is configured to transfer heat between the coolant and water flowing through the first heat exchanger. A temperature sensor is configured to detect a temperature of ambient air. A pressure sensor is configured to detect an air pressure at the evaporator. Control circuitry is in communication with the temperature sensor and the pressure sensor. The control circuitry is configured to determine presence of an obstruction on the evaporator and classify the obstruction based on the temperature of the ambient air.

According to another aspect, the control circuitry is further configured to determine a frost condition or a non-frost condition of the evaporator in response to the temperature of the ambient air.

According to yet another aspect, the system includes at least one valve fluidly interposing the compressor and the evaporator and moveable between an operating position and a defrost position.

According to yet another aspect, the control circuitry is configured to control the at least one valve to position the at least one valve to the defrost position in response to determining the frost condition.

According to yet another aspect, the control circuitry is configured to selectively operate the compressor and the at least one valve between a defrost mode and an operating mode based on the temperature and the air pressure.

According to yet another aspect, the control circuitry is configured to adjust at least one operation of the operating mode in response to determining the non-frost condition.

According to yet another aspect, the system includes an indicator, wherein the control circuitry is further configured to control the indicator to indicate the adjustment of at least one operation of the operating mode.

According to yet another aspect, the at least one valve includes a first valve controlling fluid communication between the compressor and the first heat exchanger, and wherein the control circuitry is configured to control the first valve to limit the flow of the coolant through the first heat exchanger in the defrost mode.

According to yet another aspect, the system includes a second heat exchanger fluidly interposing the first valve and the evaporator, wherein the at least one valve includes a second valve fluidly interposing the second heat exchanger and the evaporator, and wherein the control circuitry is configured to control the second valve to open in the defrost mode.

According to yet another aspect, the system includes an air intake assembly, wherein the pressure sensor measures a suction pressure of air at the air intake assembly.

According to yet another aspect, a heat pump water heater system includes a compressor configured to compress a coolant. An evaporator includes an evaporator fan that is configured to cause air to flow through the evaporator when the evaporator fan is actuated. The system includes a first heat exchanger fluidly interposing the compressor and the evaporator and configured to transfer heat between the coolant and water flowing through the first heat exchanger. The system includes a temperature sensor configured to detect a temperature of ambient air, a pressure sensor configured to detect an air pressure at the evaporator, and control circuitry in communication with the temperature sensor and the pressure sensor. The control circuitry is configured to determine presence of an obstruction on the evaporator and determine a frost condition or a non-frost condition of the evaporator in response to the temperature of the ambient air.

According to yet another aspect, the system includes at least one valve fluidly interposing the compressor and the evaporator and moveable between an operating position and a defrost position.

According to yet another aspect, the control circuitry is configured to control the at least one valve to position the at least one valve to the defrost position in response to determining the frost condition.

According to yet another aspect, the control circuitry is configured to selectively operate the compressor and the at least one valve between a defrost mode and an operating mode based on the temperature and the air pressure.

According to yet another aspect, the control circuitry is configured to adjust at least one operation of the operating mode in response to determining the non-frost condition.

According to yet another aspect, the system includes an indicator, wherein the control circuitry is further configured to control the indicator to indicate the adjustment of at least one operation of the operating mode.

According to yet another aspect, the at least one valve includes a first valve controlling fluid communication between the compressor and the first heat exchanger, and wherein the control circuitry is configured to control the first valve to limit the flow of the coolant through the first heat exchanger in the defrost mode.

According to yet another aspect, the system includes a second heat exchanger fluidly interposing the first valve and the evaporator, wherein the at least one valve includes a second valve fluidly interposing the second heat exchanger and the evaporator, and wherein the control circuitry is configured to control the second valve to open in the defrost mode.

According to yet another aspect, the system includes an air intake assembly, wherein the pressure sensor measures a suction pressure of air at the air intake assembly.

According to yet another aspect, a heat pump water heater system includes a compressor configured to compress a coolant. The system includes an evaporator including an evaporator fan that is configured to cause air to flow through the evaporator when the evaporator fan is actuated. The system includes a heat exchanger fluidly interposing the compressor and the evaporator and configured to transfer heat between the coolant and water flowing through the heat exchanger. The system includes at least one valve fluidly interposing the compressor and the evaporator and moveable between an operating position and a defrost position. The system includes a temperature sensor configured to detect a temperature of ambient air. The system includes a pressure sensor configured to detect an air pressure at the evaporator. The system includes control circuitry in communication with the temperature sensor and the pressure sensor. The control circuitry is configured to determine presence of an obstruction on the evaporator, determine a frost condition or a non-frost condition of the evaporator in response to the temperature of the ambient air, and control the at least one valve to position the at least one valve to the defrost position in response to determining the frost condition.

According to yet another aspect, a method of operating a heat pump water heater system includes compressing a coolant via a compressor, drawing air over an evaporator via actuation of an evaporator fan, transferring heat between the coolant and water flowing through a first heat exchanger fluidly interposing the compressor and the evaporator, detecting a temperature of ambient air via a temperature sensor, detecting an air pressure at the evaporator via an pressure sensor, determining presence of an obstruction on the evaporator via control circuitry in communication with the temperature sensor and the pressure sensor, and classifying the obstruction based on the temperature of the ambient air.

According to yet another aspect, the method includes determining a frost condition or a non-frost condition of the evaporator in response to the temperature of the ambient air.

According to yet another aspect, the method includes in response to determining the frost condition, communicating an indication of the obstruction to a user interface.

According to yet another aspect, the method includes in response to determining the frost condition, initiating a defrost cycle.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A heat pump water heater system, comprising:

a compressor configured to compress a coolant;

an evaporator including an evaporator fan that is configured to cause air to flow through the evaporator when the evaporator fan is actuated;

a first heat exchanger fluidly interposing the compressor and the evaporator and configured to transfer heat between the coolant and water flowing through the first heat exchanger;

a temperature sensor configured to detect a temperature of ambient air;

a pressure sensor configured to detect an air pressure at the evaporator; and control circuitry in communication with the temperature sensor and the pressure sensor and configured to:

determine presence of an obstruction on the evaporator; and classify the obstruction based on the temperature of the ambient air.

2. The system of claim 1, further comprising:

an air intake assembly, wherein the pressure sensor measures a suction pressure of air at the air intake assembly.

3. The system of claim 1, wherein the control circuitry is further configured to:

determine a frost condition or a non-frost condition of the evaporator in response to the temperature of the ambient air.

4. The system of claim 3, further comprising:

at least one valve fluidly interposing the compressor and the evaporator moveable between an operating position and a defrost position.

5. The system of claim 4, wherein the control circuitry is configured to:

control the at least one valve to position the at least one valve to the defrost position in response to determining the frost condition.

6. The system of claim 4, wherein the control circuitry is configured to selectively operate the compressor and the at least one valve between a defrost mode and an operating mode based on the temperature and the air pressure.

7. The system of claim 6, wherein the control circuitry is configured to adjust at least one operation of the operating mode in response to determining the non-frost condition.

8. The system of claim 7, further comprising:

an indicator, wherein the control circuitry is further configured to control the indicator to indicate the adjustment of at least one operation of the operating mode.

9. The system of claim 6, wherein the at least one valve includes a first valve controlling fluid communication between the compressor and the first heat exchanger, and wherein the control circuitry is configured to control the first valve to limit the flow of the coolant through the first heat exchanger in the defrost mode.

10. The system of claim 9, further comprising:

a second heat exchanger fluidly interposing the first valve and the evaporator, wherein the at least one valve includes a second valve fluidly interposing the second heat exchanger and the evaporator, and wherein the control circuitry is configured to control the second valve to open in the defrost mode.

11. A heat pump water heater system, comprising:

a compressor configured to compress a coolant;

an evaporator including an evaporator fan that is configured to cause air to flow through the evaporator when the evaporator fan is actuated;

a first heat exchanger fluidly interposing the compressor and the evaporator and configured to transfer heat between the coolant and water flowing through the first heat exchanger;

a temperature sensor configured to detect a temperature of ambient air;

a pressure sensor configured to detect an air pressure at the evaporator; and control circuitry in communication with the temperature sensor and the pressure sensor and configured to:

determine presence of an obstruction on the evaporator; and determine a frost condition or a non-frost condition of the evaporator in response to the temperature of the ambient air.

12. The system of claim 11, further comprising:

an air intake assembly, wherein the pressure sensor measures a suction pressure of air at the air intake assembly.

13. The system of claim 11, further comprising:

at least one valve fluidly interposing the compressor and the evaporator and moveable between an operating position and a defrost position.

14. The system of claim 13, wherein the control circuitry is configured to:

control the at least one valve to position the at least one valve to the defrost position in response to determining the frost condition.

15. The system of claim 13, wherein the control circuitry is configured to selectively operate the compressor and the at least one valve between a defrost mode and an operating mode based on the temperature and the air pressure.

16. The system of claim 15, wherein the control circuitry is configured to adjust at least one operation of the operating mode in response to determining the non-frost condition.

17. The system of claim 16, further comprising:

an indicator, wherein the control circuitry is further configured to control the indicator to indicate the adjustment of at least one operation of the operating mode.

18. The system of claim 17, wherein the at least one valve includes a first valve controlling fluid communication between the compressor and the first heat exchanger, and wherein the control circuitry is configured to control the first valve to limit the flow of the coolant through the first heat exchanger in the defrost mode.

19. The system of claim 18, further comprising:

a second heat exchanger fluidly interposing the first valve and the evaporator, wherein the at least one valve includes a second valve fluidly interposing the second heat exchanger and the evaporator, and wherein the control circuitry is configured to control the second valve to open in the defrost mode.

20. A heat pump water heater system, comprising:

a compressor configured to compress a coolant;

an evaporator including an evaporator fan that is configured to cause air to flow through the evaporator when the evaporator fan is actuated;

a heat exchanger fluidly interposing the compressor and the evaporator and configured to transfer heat between the coolant and water flowing through the heat exchanger;

at least one valve fluidly interposing the compressor and the evaporator and moveable between an operating position and a defrost position;

a temperature sensor configured to detect a temperature of ambient air;

a pressure sensor configured to detect an air pressure at the evaporator; and control circuitry in communication with the temperature sensor and the pressure sensor and configured to:

determine presence of an obstruction on the evaporator;

determine a frost condition or a non-frost condition of the evaporator in response to the temperature of the ambient air; and control the at least one valve to position the at least one valve to the defrost position in response to determining the frost condition.

21. A method of operating a heat pump water heater system, comprising:

compressing a coolant via a compressor;

drawing air over an evaporator via actuation of an evaporator fan;

transferring heat between the coolant and water flowing through a first heat exchanger fluidly interposing the compressor and the evaporator;

detecting a temperature of ambient air via a temperature sensor;

detecting an air pressure at the evaporator via a pressure sensor;

determining presence of an obstruction on the evaporator via control circuitry in communication with the temperature sensor and the pressure sensor; and classifying the obstruction based on the temperature of the ambient air.

22. The method of claim 21, further comprising:

determining a frost condition or a non-frost condition of the evaporator in response to the temperature of the ambient air.

23. The method of claim 22, further comprising:

in response to determining the frost condition, communicating an indication of the obstruction to a user interface.

24. The method of claim 22, further comprising:

in response to determining the frost condition, initiating a defrost cycle.

* * * * *